US005182919A

United States Patent [19]

Fujiwara

[11] Patent Number: 5,182,919

[45] Date of Patent: Feb. 2, 1993

[54] OIL RECOVERY SYSTEM FOR CLOSED TYPE CENTRIFUGAL REFRIGERATING MACHINE

[75] Inventor: Satoru Fujiwara, Tokyo, Japan

[73] Assignee: Ebara Corporation, Tokyo, Japan

[21] Appl. No.: 641,210

[22] Filed: Jan. 15, 1991

[30] Foreign Application Priority Data

Jan. 18, 1990 [JP] Japan ..... 2-10160
Jan. 18, 1990 [JP] Japan ..... 2-10161

[51] Int. Cl.[5] ..... F25B 31/00

[52] U.S. Cl. ..... 62/193; 62/84; 62/217

[58] Field of Search ..... 62/192, 193, 194, 84, 62/468, 217

[56] References Cited

U.S. PATENT DOCUMENTS 4,213,307 7/1980 Watson ..... 62/192
4,671,081 6/1987 Fujiwara et al. ..... 62/84 X
4,932,215 6/1990 Kanazawa et al. ..... 62/192 X

FOREIGN PATENT DOCUMENTS 54-49662 4/1979 Japan .
54-53339 4/1979 Japan .
56-127160 10/1981 Japan .
56-132557 11/1981 Japan .
56-132558 11/1981 Japan .
61-180860 8/1986 Japan .
55-20049 6/1990 Japan .

*Primary Examiner*—William E. Wayner

[57] ABSTRACT

An oil recovery system for a closed type centrifugal refrigerating machine. The refrigerating machine includes a compressor that has an oil sump below the suction side thereof, a condenser that liquefies compressed refrigerant gas by cooling, an evaporator that evaporates the liquefied refrigerant, a suction volume control valve that controls the volumetric flow of refrigerant gas sucked into the compressor from the evaporator, recovery means for recovering oil from the oil sump to an oil tank in a lubricating system, and control means for starting or stopping the compressor in accordance with the magnitude of refrigeration load. The oil recovery system comprises valve opening control means for controlling the opening of the suction volume control valve such that a decrease in the amount of oil recovered to the oil tank is compensated for when the number of times of start or stop of the compressor per unit of time exceeds a set number.

6 Claims, 5 Drawing Sheets

| Fig.1A |
| --- |
| Fig.1B |

OIL RECOVERY SYSTEM FOR CLOSED TYPE CENTRIFUGAL REFRIGERATING MACHINE

BACKGROUND OF THE INVENTION

The present invention relates to an oil recovery system for a closed type centrifugal refrigerating machine which is capable of effectively recovering lubricating oil that has leaked in a refrigerant even when the refrigeration load is small.

The refrigerating cycle of the closed type centrifugal refrigerating machine will be explained below with reference to FIG. 3.

Refrigerant gas A that evaporates in an evaporator 1 is sucked into a compressor 2. The volumetric flow of refrigerant gas sucked into the compressor 2 is controlled by a suction volume control valve 3, for example, a suction vane, in accordance with the magnitude of refrigeration load. The refrigerant gas compressed in the compressor 2 is discharged to a condenser 4 where it is cooled to condense into its liquid phase. The now liquid refrigerant returns to the evaporator 1 through an expansion mechanism 5, for example, an orifice. In this system, a bearing for an impeller 6 in the compressor 2, a speed increasing gear 7, etc. are lubricated by a lubricating system (not shown), which is separate from the refrigerant system.

In the closed type centrifugal refrigerating machine, the refrigerant system and the lubricating system are shut off from the outside as a whole, and these two systems are separated from each other by a sealing device. However, there is unavoidable communication between the two systems, although it is only a little. In general, oil leaks into the refrigerant system from a shaft extending portion of the compressor 2, as shown by B in FIG. 3. The leakage oil reaches the evaporator 1 through the condenser 4, together with the refrigerant gas. Since the refrigerant alone evaporates in the evaporator 1, the oil remains therein.

Usually, however, refrigerant mist is sucked into the compressor 2, together with the refrigerant gas that evaporates in the evaporator 1, so that the leakage oil is eventually dissolved in the mist and carried out of the evaporator 1. An oil sump 8 is provided at the suction side of the compressor 2, as shown in FIGS. 4 and 5. Oil that gathers in the oil sump 8 is sucked and recovered to an oil tank 13 by an ejector 11 through an ejector filter 12. The ejector 11 is disposed in the intermediate portion of a piping that connects together a scroll portion of a discharge gas passage for the gas compressed in the compressor 2 and the oil tank 13 that is equalized in pressure with the upstream side of the suction volume control valve 3. The ejector 11 uses a pressure difference between the discharge pressure and the cooler pressure as driving force to return the oil in the oil sump 8 to the oil tank 13 through the ejector filter 12 by the ejector effect caused by the refrigerant gas.

In FIG. 3, reference numeral 24 denotes a main motor for the compressor 2, and 9 a bypass line that bypasses part of the refrigerant gas flowing into the condenser 4 from the compressor 2 to the evaporator 1, the bypass line 9 being provided with a hot gas bypass valve 10. Reference numerals 14 and 15 denote a chilled water inlet and a chilled water outlet of the evaporator 1, and 16 and 17 a cooling water inlet and a cooling water outlet of the condenser 4. In addition, reference numeral 18 denotes an oil cooler, 19 a purge condenser, 20 a refrigerant pump, 21 a strainer, and 22 a refrigerant cooler.

When the conventional closed type centrifugal refrigerating machine runs in a full-load condition or a load condition which is close to it, the flow velocity of the refrigerant gas is sufficiently high that an adequate amount of refrigerant mist can accompany the refrigerant gas to effect satisfactory recovery of the leakage oil.

However, when the machine is in a partial-load condition, the amount of refrigerant mist accompanying the refrigerant gas is small, so that the amount of oil recovered becomes smaller than the amount of leakage oil, resulting in an increase in the amount of oil remaining in the evaporator 1, being dissolved in the refrigerant. In consequence, the amount of oil in the lubricating system decreases, and a low oil pressure tripping device is eventually activated to stop the refrigerating machine.

Thus, it has heretofore been necessary to supply oil to the lubricating system in order to continue the operation of the refrigerating machine without interruption.

When the load increases to a level at which a full-load running is available, the oil recovery function by the accompaniment of refrigerant gas is restored. As a result, the oil level in the oil tank rises, so that an excess of oil must be taken out of the oil tank, which burdens the operator with a very troublesome task.

There is another problem that, when the concentration of oil dissolved in the liquid refrigerant increases, the contamination of the tube in the evaporator 1 is promoted to check the heat transfer.

To prevent the occurrence of the above-described problem, one type of centrifugal refrigerating machine makes use of a differential pressure which is produced across the suction volume control valve 3 that is automatically closed during a partial-load running, to lead the liquid refrigerant having the oil dissolved therein from the evaporator 1 to the downstream side of the suction volume control valve 3, thereby recovering the leakage oil. More specifically, when the refrigerating machine is in a partial-load condition, the opening of the suction volume control valve 3 is small, so that the differential pressure across the control valve 3 becomes sufficiently large to enable the liquid refrigerant having the leakage oil dissolved therein to be sucked into the oil sump 8 by virtue of a difference between the cooler pressure and the pressure at the downstream side of the control valve 3, thus recovering the leakage oil. However, even in a centrifugal refrigerating machine with such an oil recovery function, if the compressor 2 turns on/off under a small refrigeration load condition, the temperature of chilled water rises when the compressor 2 is off, and when it turns on, the suction volume control valve 3 in the prior art is fully opened because the chilled water temperature is relatively high for the moment. However, since the load is small, the chilled water temperature lowers within a short time, thus causing the compressor 2 to turn off. Accordingly, if the compressor 2 starts and stops frequently, it is impossible to obtain sufficient time to remove the liquid refrigerant having the leakage oil dissolved therein by making use of a differential pressure across the suction volume control valve 3.

In general, the oil pump in the lubricating system performs the residual running for a predetermined period of time after suspension of the compressor 2, and the leakage of oil into the refrigerant system occurs even during the suspension of the compressor 2. For this reason, it has heretofore been impossible to solve completely the problem that the leakage oil remains in the evaporator 1 and cannot be recovered to the oil tank.

SUMMARY OF THE INVENTION

In view of the above-described circumstances, it is an object of the present invention to provide an oil recovery system for a closed type centrifugal refrigerating machine which is capable of effectively recovering lubricating oil that has leaked in a refrigerant even when the refrigeration load is small.

To attain the above-described object, the present invention provides an oil recovery system for a closed type centrifugal refrigerating machine including a compressor with a suction volume control valve, an oil sump provided at the suction side of the compressor, an oil recovery mechanism which recovers the oil gathered in the oil sump to an oil tank by a suction device, and a mechanism which automatically starts and stops the compressor in accordance with the magnitude of the load, wherein the improvement comprises a means for forcibly maintaining the opening of the suction volume control valve of the compressor above a predetermined value for a predetermined time when the number of times of automatic start or stop of the compressor per unit of time exceeds a predetermined set number.

In addition, according to the present invention, when the opening of the suction volume control valve of the compressor is maintained above a predetermined value for a predetermined time, a hot gas bypass valve that is provided in a bypass line for bypassing part of the refrigerant gas flowing into a condenser from the compressor is opened.

In the centrifugal refrigerating machine, the compressor is turned on/off by an automatic start/stop device, for example, a thermostat, which is installed at a chilled water outlet of the evaporator since satisfactory control cannot be available only with a control mechanism for the suction volume control valve, for example, a suction vane, by which the refrigeration load is reduced. When the refrigeration load is small, chilled water is cooled even more easily and returns with the lowered temperature, and the chilled water outlet temperature is therefore lowered by running the compressor for a relatively short time. For this reason, the frequency at which the compressor turns on/off rises.

According to the present invention, the number of times of start or stop of the compressor per predetermined period of time is detected, and when the detected number exceeds a set value, the opening of the suction volume control valve of the compressor is maintained above a predetermined value for a predetermined time. The term "predetermined value" herein means a degree of opening of the suction volume control valve at which the volumetric flow of the refrigerant gas is sufficient for the refrigerant liquid to accompany the refrigerant gas, and it can be determined by a trial run. By doing so, since the refrigeration load temporarily increases to a level which is higher than is necessary, the running time of the compressor shortens; however, since the volumetric flow of the refrigerant gas becomes sufficient for the refrigerant liquid to accompany the refrigerant gas, the oil gathered in the evaporator is recovered. If the compressor is run until a low suction pressure tripping device or a low refrigerant temperature tipping device or a low chilled water temperature tripping device is almost activated, the running time of the compressor also becomes sufficient for the oil recovery.

If the hot gas bypass valve for bypassing the refrigerant gas from the condenser to the evaporator is opened to a predetermined value, the load on the compressor becomes larger than the partial load in a normal running, which is against the energy saving running of the compressor. However, even when the suction volume control valve is forcibly opened to a predetermined value, there is no increase in the number of times of start and stop of the compressor per unit of time.

According to another aspect of the present invention, there is provided an oil recovery system for a closed type centrifugal refrigerating machine, which comprises a suction volume control valve opening control means for controlling the opening of the suction volume control valve for the compressor below a predetermined value when the number of times of automatic start or stop of the compressor per unit of time exceeds a predetermined set number, thereby reducing the frequency of start and stop of the compressor.

If the opening of the suction volume control valve increases, the suction gas quantity of the compressor increases and the refrigerating capacity increases. At the same time, the main motor power increases, and the main motor current value also increases.

Accordingly, it is possible to lengthen the time for the chilled water outlet temperature to lower to a set level when the refrigeration load is small, by controlling the main motor current value at a predetermined value so as to limit the degree of opening of the volume control valve to thereby prevent the increase in the refrigerating capacity. That is, the suction volume control valve opening control means may be a means for effecting control such that the current value of the main motor for the compressor will not exceed a predetermined value, by a mechanism for limiting the current of the main motor, thereby controlling the opening of the suction volume control valve below a predetermined value.

If the chilled water control temperature (i.e., the chilled water outlet set temperature) is temporarily raised above the required set temperature, the refrigeration load apparently decreases relative of the raised set temperature, so that a low-opening running is available without any increase in the opening of the suction volume control valve. Accordingly, it is possible to prevent the refrigerating capacity from increasing and lengthen the running time and hence possible to recover the leakage oil satisfactorily. That is, the suction volume control valve opening control means may be a means for controlling the opening of the suction volume control valve below a predetermined level by raising the chilled water control temperature in the refrigerating machine, thereby reducing the frequency of start and stop of the compressor.

According to the present invention, the number of times of start or stop of the compressor per predetermined time is detected, and when the detected number exceeds a set value, the opening of the suction volume control valve for the compressor is controlled below a predetermined value. The opening of the control valve is determined to be a value with which a sufficient differential pressure to suck the liquid refrigerant from the evaporator is obtained across the suction volume control valve. The value for the valve opening can be determined by a trial run. Thus, the differential pressure across the section volume control valve is sufficiently high to suck the liquid refrigerant, and the running time lengthens. Therefore, the oil gathered in the evaporator can be recovered satisfactorily.

In general, the main motor for driving the compressor is provided with a current-limiting mechanism for protecting the motor. By effecting control such that the current value of the main motor will not exceed a predetermined value, the opening of the suction volume control valve can be readily controlled at the desired level.

It is also possible to control the opening of the suction volume control valve by temporarily raising the chilled water control temperature.

DESCRIPTION OF THE PREFERRED EMBODIMENTS

One embodiment of the present invention will be described below with reference to the accompanying drawings.

Figures 1, 1A:
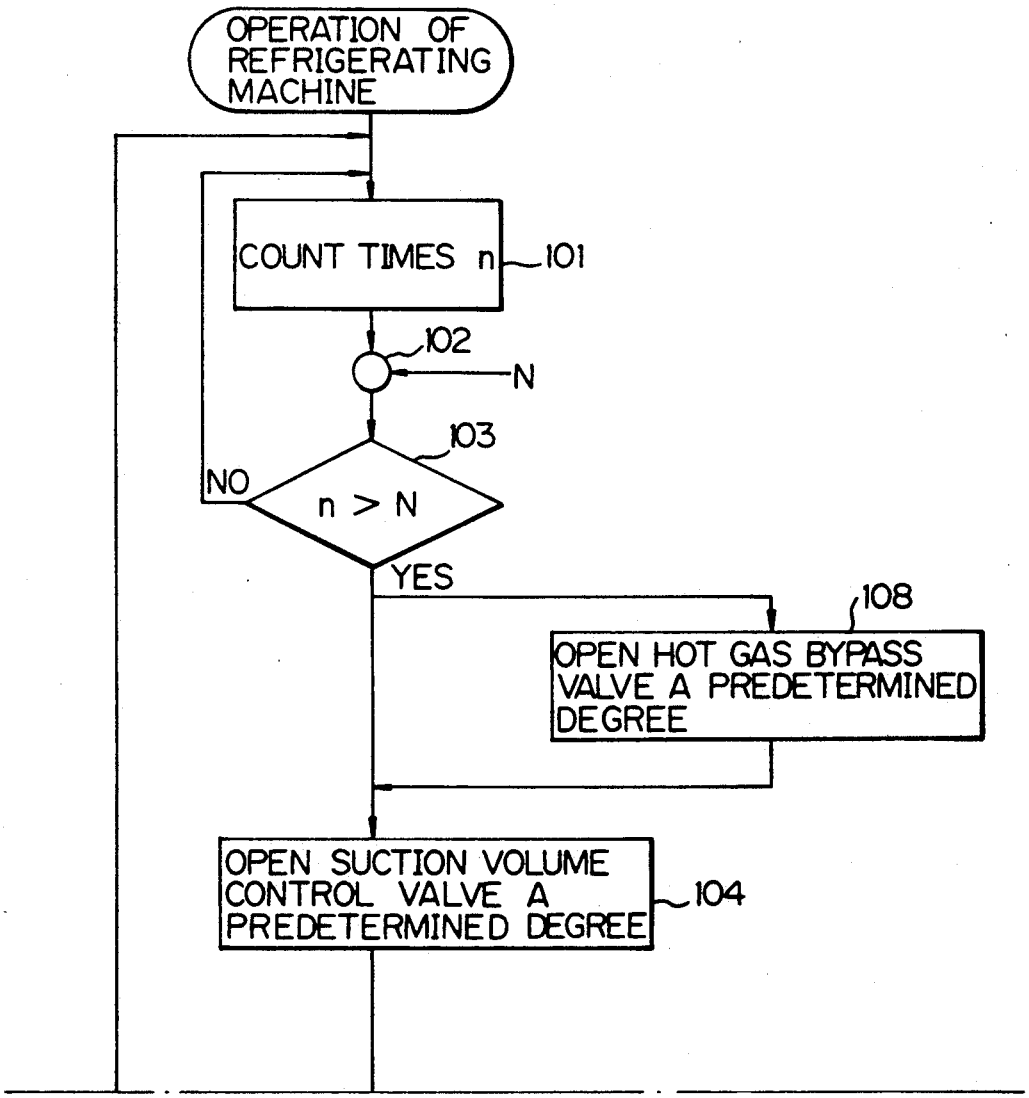
FIG. 1 shows the association of FIGS. 1A and 1B.
FIGS. 1A and 1B shown a first embodiment of a centrifugal refrigeration oil recovery system.
Figure 1B:
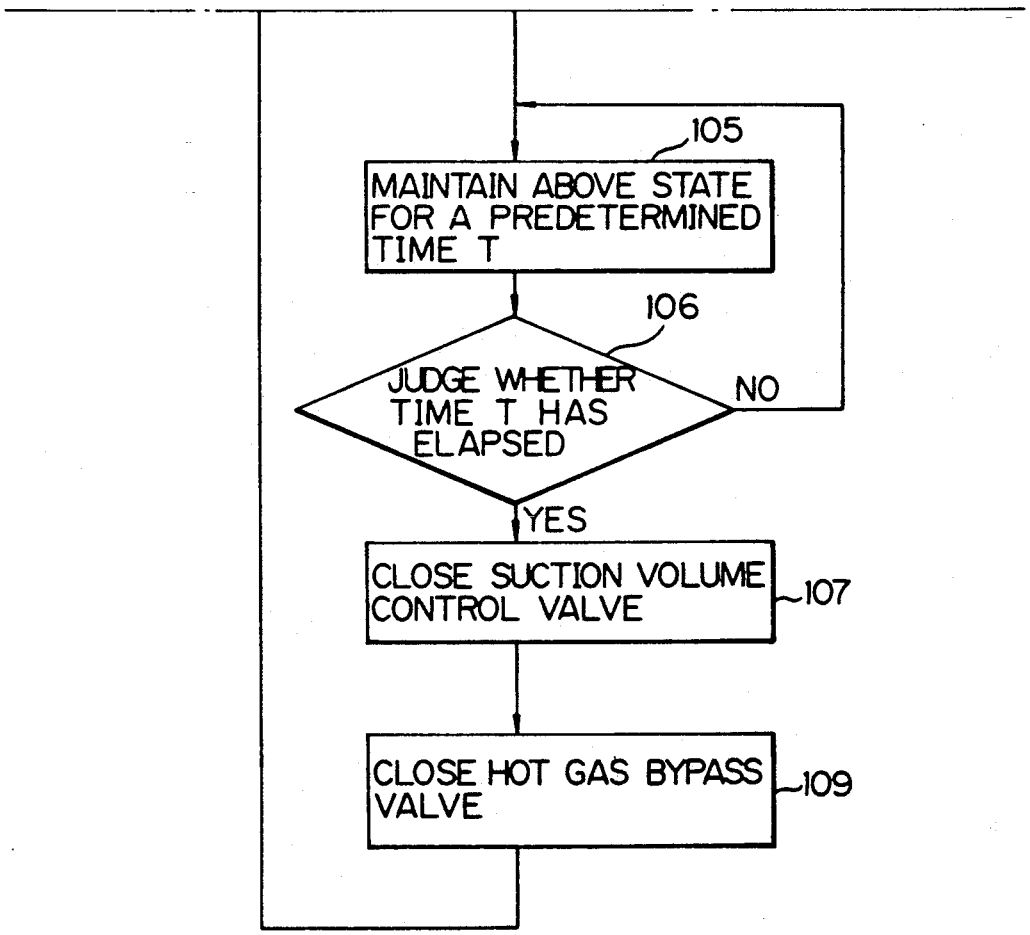
Figure 3:
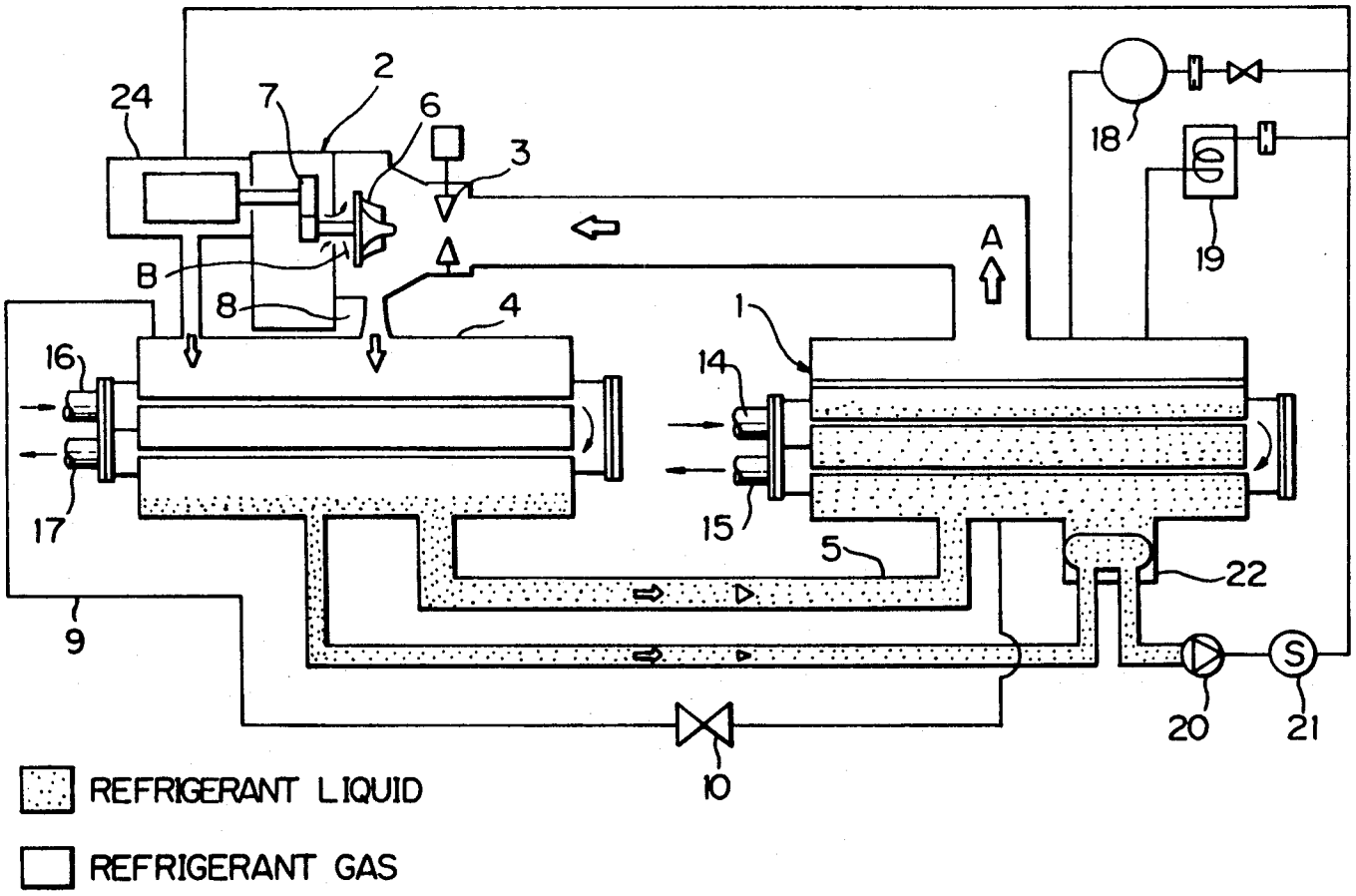
FIG. 3 shows the arrangement of a closed type centrifugal refrigerating machine.
Figure 4:
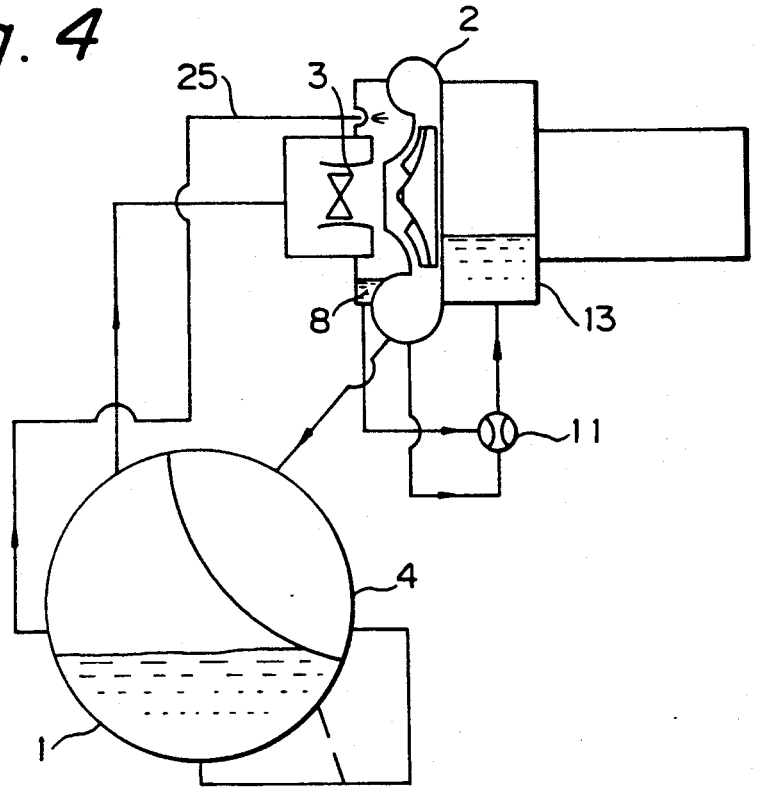
FIGS. 4 and 5 show the arrangement of an oil recovery device for a compressor.
Figure 5:
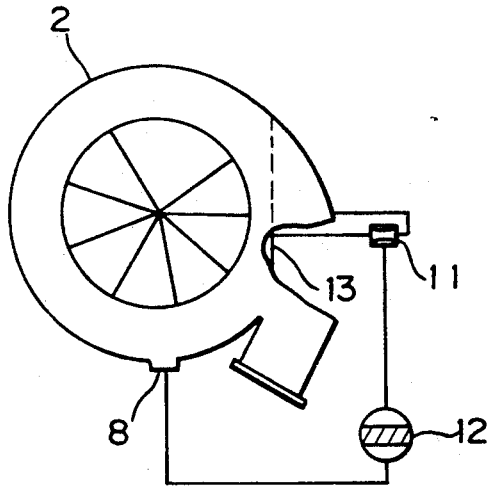

FIG. 1 is a flowchart showing the operation of one embodiment of the oil recovery system for a closed type centrifugal refrigerating machine according to the present invention. It should be noted that the arrangement of the closed type centrifugal refrigerating machine in this embodiment is the same as that shown in FIG. 3.

Referring to FIG. 1, first, the closed type centrifugal refrigerating machine is run, and the number n of times of starting of the compressor 2, that is, the number n of times of ON of the compressor 2 per unit of time during an automatic running, is counted (Step 101). Next, a comparison is made between the number n of times of ON per unit of time and a reference number N of times of ON of the compressor 2 per unit of time (Step 102). Subsequently, it is judged whether or not $n>N$ (Step 103). If YES, the suction volume control valve 3 is opened to a predetermined value (Step 104). This state is maintained for a predetermined time T, that is, for the minimum time T required for maintaining the oil recovery function (Step 105). Next, it is judged whether or not the time T has elapsed (Step 106). If YES, the suction volume control valve 3 is closed (Step 107), and the process then returns to Step 101. If NO is the answer in Step 103, that is, if n is not greater than N, the process returns to Step 101 from Step 103.

When YES is the answer in Step 103, the hot gas bypass valve 10 may be opened to a predetermined degree (Step 108). In such a case, the hot gas bypass valve 10 is closed (Step 109) after Step 107.

The above-described operation can be realized by a control means that employs a microcomputer, for example.

Another embodiment of the present invention will next be explained.

Figure 2:
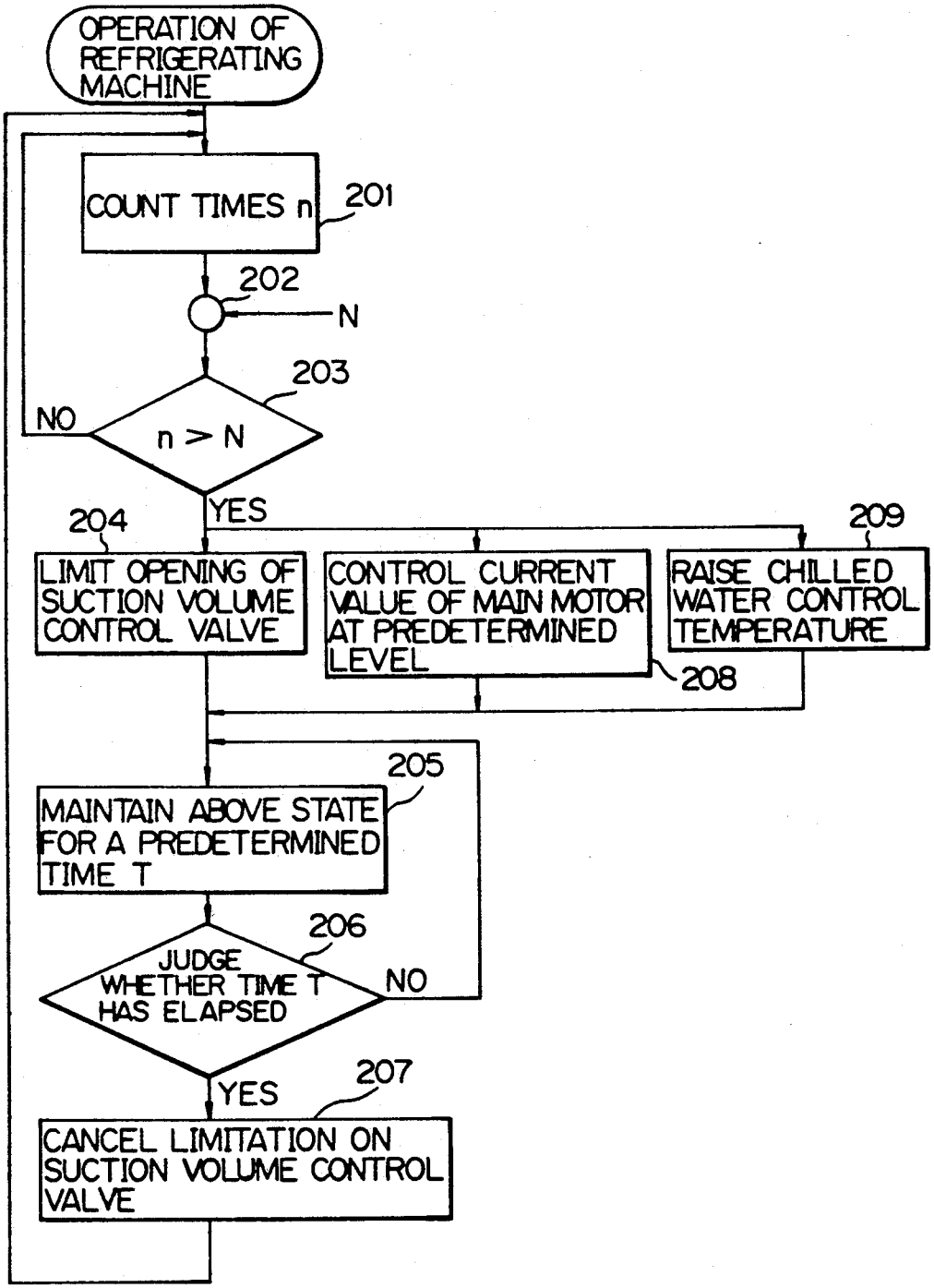
FIG. 2 shows a second embodiment.

FIG. 2 is a flowchart showing the operation of the second embodiment of the oil recovery system for a closed type centrifugal refrigerating machine according to the present invention. It should be noted that the arrangement of the closed type centrifugal refrigerating machine in this embodiment is the same as that shown in FIG. 3.

Referring to FIG. 2, first, the closed type centrifugal refrigerating machine is run, and the number n of times of starting of the compressor 2, that is, the number n of times of ON of the compressor 2 per unit of time during an automatic running, is counted (Step 201). Next, a comparison is made between the number n of times of ON per unit of time and a reference number N of times of ON of the compressor 2 per unit of time (Step 202). Subsequently, it is judged whether or not $n>N$ (Step 203). If YES, the opening of the suction volume control valve 3 is limited to a predetermined value (Step 204). This state is maintained for a predetermined time T, that is, for the time T required for maintaining the oil recovery function (Step 205). Next, it is judged whether or not the time T has elapsed (Step 206). If YES, the limitation on the suction volume control valve 3 is canceled (Step 207), and the process then returns to Step 201. If NO is the answer in Step 203, that is, if n is not greater than N, the process returns to Step 201 from Step 203.

When YES is the answer in Step 203, the current value of the main motor 9 may be controlled at a predetermined level (Step 208), or the chilled water control temperature may be raised (Step 209).

The above-described operation can be realized by a control means that employs a microcomputer, for example.

As has been described above, the present invention provides the following advantageous effects:

(1) Even if a partial-load running continues with a low oil recovery, the closed type centrifugal refrigerating machine can be continuously run without the low oil pressure tripping device being activated due to lack of oil.

(2) The present invention eliminates the need for such a troublesome operation that oil is supplied and then taken out in order to run the machine continuously.

(3) Since it is possible to check the increase in the concentration of oil dissolved in the liquid refrigerant in the evaporator, it is possible to prevent contamination of the heat transfer tube and maintain excellent heat transfer condition. Thus, an energy saving running can be attained.

What is claimed is:

1. In a closed type centrifugal refrigerating machine including a compressor that has an oil sump below the suction side thereof, a condenser that liquefies compressed refrigerant gas by cooling, an evaporator that evaporates the liquiefied refrigerant, a suction volume control valve that controls the volumetric flow of refrigerant gas sucked into said compressor from said evaporator, recovery means for recovering oil from said oil sump to an oil tank in a lubricating system, and control means for starting or stopping said compressor in accordance with the magnitude of refrigeration load, an oil recovery system for said closed type centrifugal refrigerating machine comprising:

valve opening control means for controlling the opening of said suction volume control valve to open said control valve to a predetermined degree when the number of times of operation of said compressor per unit of time exceeds a set number, the predetermined degree being greater than a normal degree of control valve opening during operations of said compressor, such that an increase in the amount of oil recovered to said oil tank is attained.

2. In a closed type centrifugal refrigerating machine including a compressor that has an oil sump below the suction side thereof, a condenser that liquefies compressed refrigerant gas by cooling, an evaporator that evaporates the liquefied refrigerant, a suction volume control valve that controls the volumetric flow of refrigerant gas sucked into said compressor from said evaporator, recovery means for recovering oil from said oil sump to an oil tank in a lubricating system, and control means for starting or stopping said compressor in accordance with the magnitude of refrigeration load, an oil recovery system for said closed type centrifugal refrigerating machine, comprising valve opening control means for controlling the opening of said suction volume control valve, said valve opening control means maintaining the opening of said suction volume control valve above a predetermined value for a predetermined time when the number of times of start or stop of said compressor per unit of time exceeds a set number, thereby compensating for a decrease in the amount of oil recovered to said oil tank.

3. An oil recovery system for a closed type centrifugal refrigerating machine according to claim 2, wherein a hot gas bypass valve is provided in a bypass line that bypasses part of the refrigerant gas from said condenser to said evaporator, and while said valve opening control means maintains the opening of said suction volume control valve above a predetermined value, said hot gas bypass valve is opened to stabilize the running of said compressor.

4. In a closed type centrifugal refrigerating machine including a compressor that has an oil sump below the suction side thereof, a condenser that liquefies compressed refrigerant gas by cooling, an evaporator that evaporates the liquefied refrigerant, a suction volume control valve that controls the volumetric flow of refrigerant gas sucked into said compressor from said evaporator, recovery means for recovering oil from said oil sump to an oil tank in a lubricating system, and control means for starting or stopping said compressor in accordance with the magnitude of refrigeration load, an oil recovery system for said closed type centrifugal refrigerating machine, comprising: means for leading the refrigerant liquid having oil dissolved therein from said evaporator to the downstream side of said suction volume control valve by making use of a differential pressure that is produced across said suction volume control valve; and valve opening control means for controlling the opening of said suction volume control valve, said valve opening control means controlling the opening of said suction volume control valve below a predetermined value when the number of times of start or stop of said compressor per unit of time exceeds a set number, thereby compensating for a decrease in the amount of oil recovered to said oil tank.

5. An oil recovery system for a closed type centrifugal refrigerating machine according to claim 4, wherein said valve opening control means effects control such that the current value of a main motor for said compressor will not exceed a predetermined value, thereby reducing the number of times of start or stop of said compressor.

6. An oil recovery system for a closed type centrifugal refrigerating machine according to claim 4, wherein said valve opening control means raises the chilled water control temperature in said refrigerating machine to reduce the number of times of start or stop of said compressor.

* * * * *